United States Patent [19]

Gullichsen

[11] Patent Number: 4,826,398

[45] Date of Patent: May 2, 1989

[54] MEDIUM CONSISTENCY PUMP WITH SELF-FEEDING

[75] Inventor: Johan Gullichsen, Sjundea, Finland

[73] Assignee: Kamyr AB, Karlstad, Sweden

[21] Appl. No.: 70,058

[22] Filed: Jul. 6, 1987

[51] Int. Cl.[4] ..... F01D 1/10

[52] U.S. Cl. ..... 415/143; 415/208.3; 415/121.1; 415/208.2; 416/181; 55/203

[58] Field of Search ..... 415/143, 121 B, 168, 415/198.1, 71–74, 182, 185, 186, 208, 183, 216; 416/176, 181, 183, 188; 55/203, 409; 68/181 R; 366/265, 329

[56] References Cited

U.S. PATENT DOCUMENTS

| | | | |
|---|---|---|---|
| 2,483,335 | 9/1949 | Davis | 415/215 |
| 3,610,590 | 10/1971 | Kaelin | 415/215 |
| 3,945,761 | 3/1976 | Araoka | 416/188 |
| 4,273,562 | 6/1981 | Niskanen | 55/52 |
| 4,410,337 | 10/1983 | Gullichsen et al. | 55/409 |
| 4,435,193 | 3/1984 | Gullichsen et al. | 55/21 |
| 4,531,892 | 7/1985 | Nasman et al. | 417/205 |
| 4,619,736 | 10/1986 | Henricson et al. | 415/121 B |
| 4,621,507 | 11/1986 | Lundqvist | 68/181 |
| 4,637,779 | 1/1987 | Sherman et al. | 415/143 |
| 4,650,342 | 3/1987 | Goodwin | 415/121 B |
| 4,675,033 | 6/1987 | Fellman et al. | 55/203 |

FOREIGN PATENT DOCUMENTS

| | | | |
|---|---|---|---|
| 926372 | 5/1982 | U.S.S.R. . | |
| 268572 | 12/1927 | United Kingdom | 415/121 B |

*Primary Examiner*—Robert E. Garrett
*Assistant Examiner*—John T. Kwon
*Attorney, Agent, or Firm*—Nixon & Vanderhye

[57] ABSTRACT

A suspension, such as paper pulp, having a consistency of between about 6–20% (i.e. medium consistency) is pumped without the necessity of using a vacuum system to effect gas removal. A hollow shaft having elongated slots in it, has impeller blades disposed on its exterior surface. Connected to the suspension inlet end of the shaft is a hollow boat-type propeller which positively feeds suspension directly to the impeller blades. The propeller is disposed in a vessel having an enlarged cross-section with respect to the pump housing, and anti-rotation bars are placed around the propeller in the vessel to prevent rotation of its suspension, so that it is fed by the propeller. The propeller pressurizes any gas separated from the suspension so that it can be removed from the suspension by the pump without a vacuum system.

28 Claims, 2 Drawing Sheets

MEDIUM CONSISTENCY PUMP WITH SELF-FEEDING

BACKGROUND AND SUMMARY OF THE INVENTION

The invention relates to a centrifugal pump, and a method of pumping medium consistency suspensions such as paper pulp, that is effective yet does not require the utilization of a vacuum system or the like to remove gas from the pump. The invention is particularly applicable to medium consistency finely comminuted cellulosic fibrous material suspensions (paper pulp) which have a consistency of between about 6–20%.

Many of the prior art pumps utilized for pumping paper pulp of medium consistency, have vacuum systems associated therewith, such as shown in U.S. Pat. Nos. 4,435,193, 4,410,337, and 4,273,562. Vacuum systems typically are not needed if the pumps are installed on the bottoms of high density towers or on the bottoms or sides of long chutes (e.g. 10 meters or greater). Approaches have been suggested for mechanically feeding suspension to the pump so that even where short chutes or towers or vessels are utilized it is not necessary to degas the suspension. Typical of this latter approach are U.S. Pat. Nos. 4,531,892 and 4,637,779. While such approaches can be generally successful, there are practical difficulties associated therewith, and/or the equipment is more complicated than is desired.

According to the present invention, a centrifugal pump is provided which is simple in construction yet can effectively mechanically feed the pulp to the impeller of a centrifugal pump so that a vacuum system is not necessary though the pump can be employed in short chutes, towers, or the like. This is accomplished according to the invention by providing the pump as a hollow shaft having elongated slots allowing communication between the interior and exterior thereof. Impeller blades are mounted on the shaft and extend from the inlet generally toward the outlet of the centrifugal pump. A simple self-feeding means, preferably a boat-type propeller, is mounted on the shaft for rotation with the shaft. The propeller is hollow and preferably extends exteriorly of the pump housing into the chute, tower, or other vessel with which the pump is associated. Anti-rotation means, which preferably comprise a plurality of stator vanes disposed in the vessel generally parallel to the axis of rotation, and having portions thereof defining an imaginary circle concentric with the shaft, ensure that the suspension acted upon by the propeller will be fed directly to the impeller blades, rather than merely rotating. The pump housing is open between the propeller and the impeller blades so that the suspension is fed directly from one to the other.

Utilizing the centrifugal pump according to the invention it is possible to pump medium consistency (e.g. about 6–20%) pulp or a like suspension. The method according to the invention comprises the following steps: continuously acting upon the suspension to progressively: Effect feeding of the suspension in a first dimension under the influence of a rotating element, while preventing significant rotation of the suspension during such feeding. After feeding of the suspension immediately effecting fluidization thereof so as to centrifugally pump the suspension to another location; and the steps being practiced so that degassing of the suspension is avoided. Alternatively, degassing can be accomplished without a vacuum system since the propeller pressurizes the gas and forces it out the pump.

It is the primary object of the present invention to provide for the simple yet effective self-feeding of medium consistency suspension, and subsequent centrifugal pumping thereof. This and other objects of the invention will become clear from an inspection of the detailed description of the invention and from the appended claims.

DETAILED DESCRIPTION OF THE DRAWINGS

Figure 1:
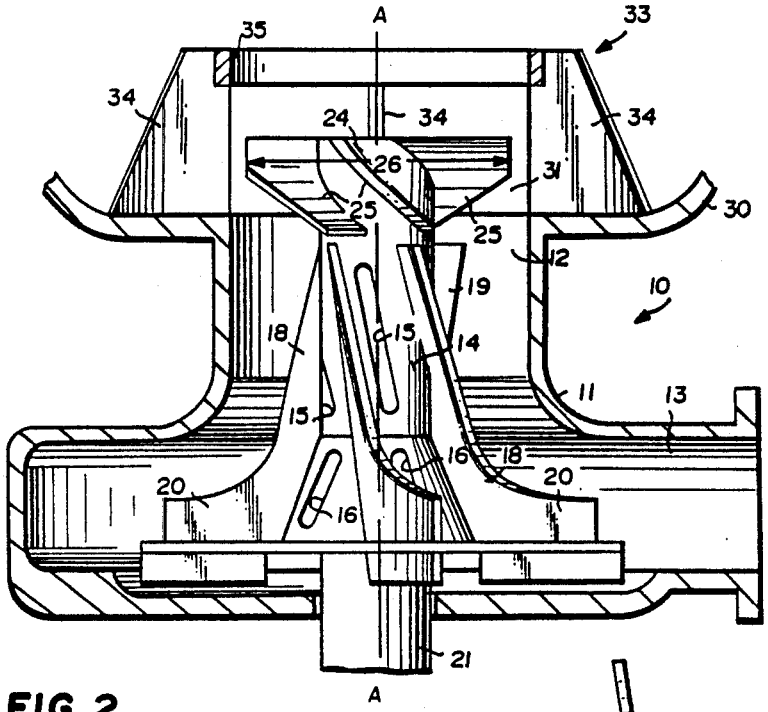
FIG. 1 is a side view, partly in cross-section and partly in elevation, of an exemplary centrifugal pump according to the present invention shown in association with an opening in the bottom of a vessel containing suspension to be pumped.

A centrifugal pump according to the present invention is shown generally by reference numeral 10 in FIG. 1. The pump comprises a main housing 11 including a suspension (e.g. pulp) inlet 12 and a suspension outlet 13 generally transverse to the inlet 12. A shaft 14 is mounted by bearings or the like (not shown) for rotation about axis A—A, generally in alignment with the inlet 12. The shaft 14 is hollow having a plurality of elongated slots 15, 16 therein, the slots 15, 16 being generally, although typically not exactly, parallel to the axis A—A, and allowing communication between the interior and the exterior of the hollow shaft 14. In the FIGS. 1–3 embodiment, typically gas in the pulp would collect at shaft 14, pass through openings 15 into shaft 14, and then will pass out slots 16 and be discharged with the pulp out outlet 13.

A fluidizing impeller is associated with the rotating shaft 14. The impeller preferably takes the form of a plurality of impeller blades or vanes 18. These vanes have a first portion 19 thereof which is generally, although typically not exactly, parallel to the axis A—A, the vanes gradually changing direction at the central portion thereof and providing a second portion 20 thereof which is generally, although typically not exactly, perpendicular to the axis A—A. The shaft 14, with attached blades 18, is rotated about the axis A—A at high speed as by motor-driven shaft 21, effecting fluidization of suspension that it pumps and pumping the suspension from the housing inlet 12 to the outlet 13.

The pump 10 according to the invention includes means for positively feeding suspension to the impeller blades 18. That is the pump 10 includes means that make the pump self-feeding. In the preferred embodiment illustrated in the drawing, the self-feeding means take the form of a boat-type propeller 24, which has vanes 25. The propeller 24 is hollow, and is disposed so that the vanes 25 thereof force suspension directly to the impeller blades 18, much like the vanes of a boat propeller force the water away from the boat. The propeller 24 is affixed to the shaft 14, the shaft 14 and propeller 24 both typically being made of metal.

Note that the housing 11 is open between the propeller 24 and the blades 18; that is there are no intervening elements that might retard the direct feeding of suspension from the propeller blades 25 to the impeller blades 18.

The propeller 24 is preferably disposed with respect to the housing 11 so that it is exterior of the housing (or at least a majority thereof is exterior of the housing), at the suspension inlet 12, as illustrated in FIG. 1. Typically, the propeller 24 extends into the interior of a vessel 30, such as a chute or a tower, with which the pump 10 is associated. The maximum diameter 26 of the propeller 24 is typically just slightly smaller than the internal diameter of the suspension inlet 12, and the diameter of the opening 31 in the bottom of the vessel 30 cooperating with the suspension inlet 12.

Figure 3:
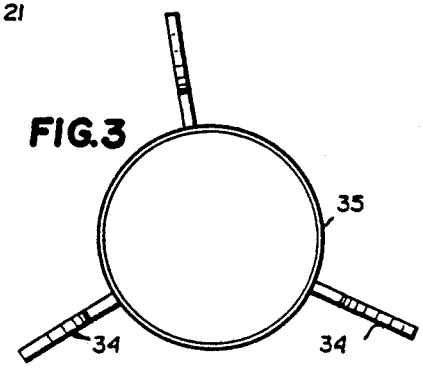
FIG. 3 is a top plan view of the anti-rotation means in the vessel of the structure of FIG. 1.

Of course a major purpose of the propeller 24 is to effect feeding of suspension to the impeller blades 18. In order to facilitate that function, it is desirable, and in some cases necessary, to prevent rotation of the propeller 24 from being merely translated into rotation of the suspension. In order to accomplish that function, anti-rotation means, shown generally by reference numeral 33, are provided. The anti-rotation means 33, as illustrated in FIGS. 1 and 3, preferably comprise a plurality of stator vanes 34 that are disposed around the propeller 24, being welded or otherwise attached to the vessel 30. A ring 35 may be welded or otherwise attached to the stator vanes 34 at the top portions thereof in order to provide rigidity. The vanes 34 extend generally, although not necessarily exactly, parallel to the axis A—A, and they are mounted exteriorly of the propeller 24. Typically, the interiormost edges of the vanes 34 define an imaginary circle concentric with the axis A—A, and in fact of approximately the same dimensions as the inlet 12 and opening 31. The vanes may be disposed radially, as illustrated in the drawings.

Figure 2:
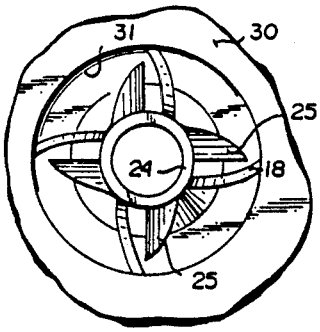
FIG. 2 is a top plan view of the rotatable component of the pump of FIG. 1, particularly showing the configuration of the propeller and impeller vanes, and looking down from the vessel, with the anti-rotation structures in the vessel removed.

In a typical operation of the structure according to FIGS. 1-3 of the invention, the motor-driven shaft 21 effects rotation of the shaft 14 and blades 18 and propeller 24 attached thereto, the shaft 14 being rotated at a speed (e.g. about 2500-3500 rpm) high enough so that the blades 18 effect fluidization of suspension having a consistency of between about 6-20%. The propeller contacts pulp within the vessel 30, and feeds the pulp, with blades 25, toward the impeller blades 18. Any pulp that is rotated too forcefully will impact the stator vanes 34 and the rotation will be terminated, so that a swirling mass does not develop in the bottom of the vessel 30. Once the pulp is received by the vanes 18 it is fluidized, and pumped from the inlet 12 to the outlet 13. The propeller 24 provides sufficient self-feeding action so that the pump 10 may operate without being hung up, yet without the necessity of a vacuum structure for removing gas from the pump.

Figure 4:
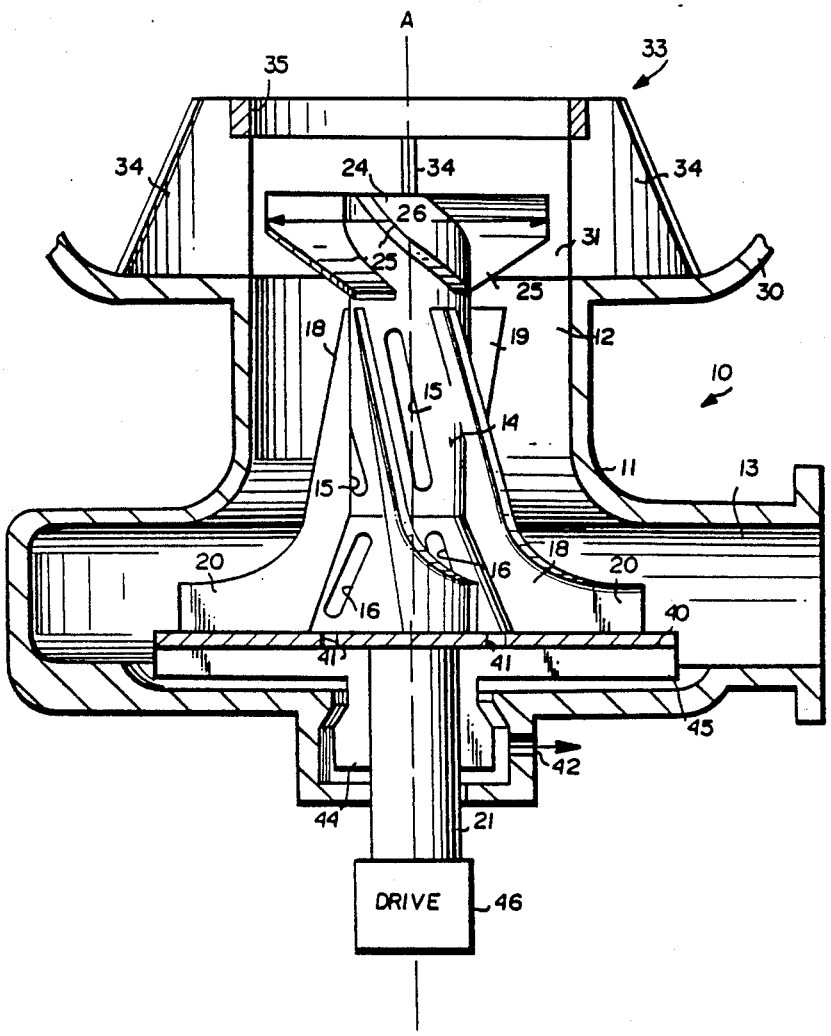
FIG. 4 is a view like FIG. 1 of an alternative embodiment of a pump according to the invention.

In the FIG. 4 embodiment, structures identical to those in the FIGS. 1 through 3 embodiment are shown by the same reference numeral.

In the FIG. 4 embodiment, provision is made for removal of the gas in the pulp through different means than the outlet 13. In the FIG. 4 embodiment, gas collecting in shaft 14 and passing through the slots 15, 16 into the hollow interior of shaft 14 will pass through one of a plurality of openings 41 in the plate 40 mounting the blades 18 and connecting the shaft 14 to the driven-shaft 21. The openings 41 are disposed beneath the portion of shaft 14 containing the slots 16, and may be disposed in any desired configuration, such as in a circular configuration. Gas that passes through openings 41 is acted upon by the wings 44, 45, the wings 44 in particular throwing out pulp which may pass with the gas through the openings 41, and also keeping the area around the shaft 21 clear and open. The gas is discharged through the opening 42 in housing 11. Conventional drive 46 drives the shaft 21.

In the embodiment of FIG. 4, it will be seen that gas removal is effected separate from the suspension pumping, but without the necessity of a vacuum system. The reason why the structure of FIG. 4 can operate to effect removal without a vacuum system is that the propeller 24 creates a pressure that acts on the gas that is greater than atmospheric pressure, and therefore there is a tendency for the gas to be forced out of the device 10. Without the propeller 24 the apparatus of FIG. 4 would not correctly function to separate gas from the pulp being pumped.

Thus, it will be seen that according to the present invention a simple and effective apparatus is provided for centrifugal pumping of medium consistency slurries even from short chutes or towers, or like vessels, without the necessity of a vacuum gas removal system; and an associated simplified method for effecting pumping. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A pump comprising: a main housing including a suspension inlet and a suspension outlet generally transverse to said suspension inlet; a shaft rotatable about an axis of rotation generally in alignment with said inlet; a fluidizing impeller mounted to said shaft for rotation therewith for effecting fluidization of suspension pumped by said impeller from said inlet to said outlet, said fluidizing impeller comprising impeller blades having first portions elongated in a first dimension generally parallel to said axis of rotation, and comprising second impeller blade portions extending in a dimension generally perpendicular to said first impeller blade portions; and self-feeding means including a boat-type propeller connected to said shaft for positively feeding suspension directly to said impeller blades for fluidization and without fixed or rotary blades intervening between said impeller and said self-feeding means.

2. A pump as recited in claim 1 wherein said self-feeding means extends exteriorly of said housing along said axis of rotation.

3. A pump as recited in claim 1 wherein said propeller is hollow.

4. A pump as recited in claim 3 wherein said shaft is hollow.

5. A pump as recited in claim 4 wherein said shaft includes means defining a plurality of openings therein along the length thereof providing communication between the hollow interior thereof and the exterior thereof.

6. A pump as recited in claim 5 wherein said hollow shaft and said impeller blades are mounted on a supporting plate, and further comprising means defining openings in said supporting plate for allowing passage of gas within said hollow shaft through said openings to be expelled from said housing separate from the suspension being pumped.

7. A pump as recited in claim 6 further comprising a plurality of wings elongated in the dimension of elongation of said shaft and disposed below said plate, said wings facilitating separation of gas from the suspension, discharged separately from said housing, without the necessity of a vacuum gas removal system.

8. A pump as recited in claim 5 further comprising anti-rotation means mounted adjacent said propeller for preventing suspension from rotating under the action of the propeller, and rather being fed positively by the propeller toward the impeller blades.

9. A pump as recited in claim 8 wherein said anti-rotation means comprises a plurality of stationary vanes each extending generally parallel to the axis of rotation and having portions thereof connected by an imaginary circle concentric with said propeller.

10. A pump as a recited in claim 9 wherein said propeller extends exteriorly of said housing into a vessel, and wherein said anti-rotation means are disposed in said vessel.

11. A pump as recited in claim 1 further comprising anti-rotation means mounted adjacent said propeller for preventing suspension from rotating under the action of the propeller, and rather being fed positively by the propeller toward the impeller blades.

12. A pump as a recited in claim 11 wherein said propeller extends exteriorly of said housing into a vessel, and wherein said anti-rotation means are disposed in said vessel; and wherein said propeller has a maximum diameter slightly less than the interior diameter of said housing at said suspension inlet.

13. A centrifugal pump comprising: a main housing including a suspension inlet and a suspension outlet generally transverse to said suspension inlet; a hollow shaft rotatable about an axis of rotation generally in alignment with said inlet; a fluidizing impeller mounted to said shaft for rotation therewith for effecting fluidization of suspension pumped by said impeller from said inlet to said outlet, said fluidizing impeller comprising a plurality of impeller blades disposed on the exterior of said hollow shaft; and a hollow boat-type propeller mounted on said shaft adjacent said suspension inlet, for rotation with said shaft to effect feeding of suspension directly to said impeller blades, said housing being open and without fixed or rotary blades intervening between said propeller and said impeller blades.

14. A pump as recited in claim 13 further comprising anti-rotation means mounted adjacent said propeller for preventing suspension from rotating under the action of the propeller, and rather being fed positively by the propeller toward the impeller blades.

15. A pump as recited in claim 14 wherein said anti-rotation means comprises a plurality of stationary vanes each extending generally parallel to the axis of rotation and having portions thereof connected by an imaginary circle concentric with said propeller.

16. A pump as a recited in claim 15 wherein said propeller extends exteriorly of said housing into a vessel, and wherein said anti-rotation means are disposed in said vessel.

17. A pump as recited in claim 13 wherein said shaft includes means defining a plurality of openings therein along the length thereof providing communication between the hollow interior thereof and the exterior thereof, a plate mounting said hollow shaft and said impeller blades, and means defining a plurality of openings in said plate, gas within said hollow shaft passing through said plate openings and out said housing distinct from the suspension being pumped so that gas separated from the suspension by said pump without the necessity of a vacuum removal system.

18. A pump according to claim 13 wherein said shaft includes axially spaced means defining inlet and outlet openings along the length thereof enabling gas adjacent said shaft to flow through said inlet openings into the interior thereof and flow from the interior of said shaft through said outlet openings for discharge with the suspension through said suspension outlet.

19. A centrifugal pump comprising:

a main housing including a suspension inlet and a suspension outlet generally transverse to said suspension inlet; a shaft rotatable about an axis of rotation generally in alignment with said inlet; a fluidizing impeller mounted to said shaft for rotation therewith for effecting fluidization of suspension pumped by said impeller from said inlet to said outlet;

said suspension inlet connected to a vessel having an enlarged cross-sectional area compared to said suspension inlet; self-feeding means mounted to said shaft for rotation therewith, said self-feeding means disposed in said vessel adjacent said suspension inlet for feeding suspension from said vessel to said pump impeller blades; and anti-rotation means disposed in said vessel for preventing the suspension from rotating under the action of said self-feeding means, so that said self-feeding means directs the suspension to said impeller blades.

20. A pump as recited in claim 19 wherein said shaft is hollow and wherein said self-feeding means comprises a hollow element, said shaft having means defining openings therein providing communication between the interior thereof and the exterior thereof.

21. A pump as recited in claim 19 wherein said anti-rotation means comprises a plurality of stationary vanes each extending generally parallel to the axis of rotation and having portions thereof connected by an imaginary circle concentric with said self-feeding means.

22. A method of pumping a suspension having a consistency between about 6–20% comprising the step of continuously acting upon the suspension to progressively (a) effect feeding of the suspension in a first dimension under the influence of a rotating element, while preventing significant rotation of the suspension during such feeding; and (b) after feeding of the suspension immediately effecting fluidization thereof so as to centrifugally pump the suspension to another location; said steps being practiced so that the use of a vacuum gas removal system for the suspension is avoided.

23. A method as recited in claim 22 wherein step (a) is practiced to effect pressurization of any gas within the suspension separated from the suspension, and comprising the further step of providing for passage of the gas that has been pressurized in a different path in the suspension so that the gas is separated from the suspension during pumping of the suspension.

24. A method according to claim 22 including the step of removing the gas during fluidization of the suspension and reintroducing the removed gas downstream of its removal for pumping with the suspension.

25. A pump comprising: a main housing including a suspension inlet and a suspension outlet generally transverse to said suspension inlet; a shaft rotatable about an axis of rotation generally in alignment with said inlet; a fluidizing impeller carried by said shaft for rotation therewith for effecting fluidization of suspension pumped by said impeller from said inlet to said outlet, said fluidizing impeller comprising impeller blades having first portions elongated in a first dimension generally parallel to said axis of rotation, and comprising second impeller blade portions extending in a dimension generally perpendicular to said first impeller blade portions; and self-feeding means connected to said shaft for positively feeding suspension directly to said impeller blades for fluidization, said self-feeding means comprising a boat-type propeller, said shaft being hollow and including axially spaced means defining inlet and outlet openings along the length thereof adjacent said first and second portions, respectively, of said impeller blades, enabling gas adjacent said shaft to flow through said inlet openings into the interior thereof and flow from the interior of said shaft through said outlet openings for discharge with the suspension through said suspension outlet.

26. A pump according to claim 25 further comprising anti-rotation means mounted adjacent said propeller for preventing suspension from rotating under the action of the propeller, and positively feeding the suspension by the propeller in a direction toward the impeller blades.

27. A pump according to claim 26 wherein said anti-rotation means comprises a plurality of stationary vanes each extending generally parallel to the axis of rotation and having portions thereof connected by an imaginary circle concentric with said propeller.

28. A pump according to claim 27 wherein said propeller extends exteriorly of said housing into a vessel, and wherein said anti-rotation means are disposed in said vessel.

* * * * *